US010745243B2

(12) United States Patent
Geisshüsler et al.

(10) Patent No.: US 10,745,243 B2
(45) Date of Patent: Aug. 18, 2020

(54) ELEVATOR COMPRISING A DECENTRALIZED ELECTRONIC SAFETY SYSTEM

(71) Applicant: Inventio AG, Hergiswil (CH)

(72) Inventors: Michael Geisshüsler, Lucerne (CH); David Michel, Thalwil (CH)

(73) Assignee: INVENTIO AG, Hergiswil (CH)

( * ) Notice: Subject to any disclaimer, the term of this patent is extended or adjusted under 35 U.S.C. 154(b) by 431 days.

(21) Appl. No.: 15/518,500

(22) PCT Filed: Oct. 20, 2015

(86) PCT No.: PCT/EP2015/074211

§ 371 (c)(1),
(2) Date: Apr. 12, 2017

(87) PCT Pub. No.: WO2016/062686

PCT Pub. Date: Apr. 28, 2016

(65) Prior Publication Data

US 2017/0233221 A1 Aug. 17, 2017

(30) Foreign Application Priority Data

Oct. 21, 2014 (EP) ..... 14189798

(51) Int. Cl.
*B66B 5/06* (2006.01)
*B66B 5/00* (2006.01)
(Continued)

(52) U.S. Cl.
CPC ..... *B66B 5/0031* (2013.01); *B66B 1/32* (2013.01); *B66B 1/3492* (2013.01); *B66B 1/36* (2013.01);
(Continued)

(58) Field of Classification Search
USPC ..... 187/247
See application file for complete search history.

(56) References Cited

U.S. PATENT DOCUMENTS 5,323,878 A * 6/1994 Nakamura ..... B66B 1/32 187/264
7,775,330 B2 * 8/2010 Kattainen ..... B66B 5/04 187/393
(Continued)

FOREIGN PATENT DOCUMENTS

CN 1694839 A 11/2005
CN 1791546 A 6/2006
(Continued)

*Primary Examiner* — Christopher Uhlir
(74) *Attorney, Agent, or Firm* — William J. Clemens; Shumaker, Loop & Kendrick, LLP

(57) ABSTRACT

An elevator includes a drive, a car operatively connected to the drive to traverse along a travel path, at least one guide rail positioned along the travel path to guide the car, a safety brake arranged on the car to exert a braking force on the guide rail, and a safety system. The safety system includes a first safety control unit and a second safety control unit that monitor a safety condition of the elevator. The first safety control unit outputs a stop signal to the drive, in particular to a drive brake and/or to a frequency converter of the drive, and the second safety control unit outputs a trigger signal to the safety brake to bring the elevator into a proper safety condition when an impermissible safety condition of the elevator is detected.

14 Claims, 3 Drawing Sheets

(51) Int. Cl.

| | |
|---|---|
| ***B66B 1/32*** | (2006.01) |
| ***B66B 1/34*** | (2006.01) |
| ***B66B 1/36*** | (2006.01) |
| ***B66B 5/18*** | (2006.01) |
| ***B66B 9/00*** | (2006.01) |

(52) U.S. Cl.
CPC ..... *B66B 5/06* (2013.01); *B66B 5/18* (2013.01); *B66B 9/00* (2013.01)

(56) References Cited

U.S. PATENT DOCUMENTS

| | | | | |
|---|---|---|---|---|
| 7,896,135 | B2 * | 3/2011 | Kattainen | B66B 1/30 187/248 |
| 8,177,035 | B2 * | 5/2012 | Ueda | B66B 5/0062 187/293 |
| 10,124,987 | B2 * | 11/2018 | Shibata | B66B 1/32 |
| 2005/0269163 | A1 | 12/2005 | Angst | |
| 2013/0118836 | A1 | 5/2013 | Rossignol | |
| 2015/0008076 | A1 * | 1/2015 | Muller | B66B 1/3492 187/394 |
| 2015/0251877 | A1 * | 9/2015 | Niikawa | B66B 5/04 187/305 |

FOREIGN PATENT DOCUMENTS

| | | | |
|---|---|---|---|
| EP | 1602610 | A1 | 12/2005 |
| EP | 2022742 | A1 | 2/2009 |
| WO | 2013057216 | A1 | 4/2013 |

* cited by examiner 2 first safety control unit 3 second safety control unit
11 drive 12 car 14 drive brake
16 safety brake 17 position and/or speed sensor
19 elevator control unit 21 counterweight 2 first safety control unit
3 second safety control unit
11 drive 12 car 14 drive brake
15 frequency converter
16 safety brake
17 position and/or speed sensor
18 acceleration sensor
19 elevator control unit
35 switch
36 limit position switch

ELEVATOR COMPRISING A DECENTRALIZED ELECTRONIC SAFETY SYSTEM

FIELD

The present invention relates to an elevator comprising a safety system having a first safety control unit and a second safety control unit that monitor a safety status of the elevator in order to bring the elevator into a proper safety condition when an impermissible safety condition of the elevator is detected.

BACKGROUND

In the past few years the development of safety systems for elevators has been directed towards the replacement of existing analogue safety circuits having series-connected safety contacts by bus-based electronic safety systems.

The patent EP 2022742 A1 shows an example of such a bus-based electronic safety system. That document relates to a decentralized safety system comprising two safety control units. One safety control unit is arranged on the car and a further safety control unit is assigned to the shaft. Both of the safety control units are connected via a safety-based bus. The one safety control unit on the car performs the task of monitoring all position-dependent and velocity-dependent safety-relevant motion states of the car. The other safety control unit, by contrast, primarily monitors safety contacts, such as shaft door contacts or shaft end contacts.

The decentralized safety system presented in EP2022742 A1 follows the premise of evaluating the locally available sensor and contact signals by means of the locally arranged safety control unit and monitoring the safety functions which are dependent thereon. Thus, for example, the one safety control unit evaluates the position and speed signals available on the car and compares them with a set of limit curves stored on the safety control unit. If the speed of the car exceeds a limit value specified for a certain position, then the first safety control unit triggers the drive brake or the safety brake. Accordingly, the other safety control unit monitors the condition of the shaft door contacts, for example, and after detecting an invalid safety condition of a shaft door contact, triggers the drive brake or the safety brake in turn. An invalid safety condition for a shaft door exists, for example, if the shaft door of a landing is open but at the same time no car is present on the corresponding floor.

A disadvantage of this safety system is that the computing power available on the one safety control unit for monitoring the position-dependent and velocity-dependent safety-relevant motion states of the car is relatively high in comparison to the computing power available on the other safety control unit for monitoring the safety contacts. Accordingly, the first safety control unit is relatively expensive to procure.

SUMMARY

It is an object of the present invention therefore to provide an inexpensive safety system for an elevator.

This object is achieved by an elevator, which comprises a drive and a car that is operatively connected to the drive and can be moved along a travel path. In addition, the elevator has at least one guide rail, which is arranged along the travel path and guides the car, as well as a safety brake, which is arranged on the car and is designed to exert a braking force on the guide rail. A safety system is also provided, which comprises a first safety control unit and a second safety control unit and which monitors a safety condition of the elevator. The elevator is characterized in that the first safety control unit is designed to output a stop signal to the drive, in particular to a drive brake and/or to a frequency converter of the drive, and that the second safety control unit is designed to output a trigger signal to the safety brake, in order to bring the elevator into a proper safety condition when an impermissible safety condition of the elevator is detected.

An impermissible safety condition is to be understood here as meaning a condition of the elevator in which a safe operation of the elevator is not guaranteed. An impermissible safety condition is present, for example, if a shaft door on a landing is open while at the same time no car is positioned on the corresponding floor, if the car reaches an excess speed or the car passes over a shaft limit switch. Correspondingly, a proper safety condition of the elevator is one in which a safe operation of the elevator is guaranteed.

The term 'sending a stop signal' to the drive is to be understood as meaning an action initiated by the safety system in order to apply a targeted braking to the car by means of the drive. This includes, for example, the direct activation or regulation of the drive brake or of the frequency converter, or else an indirect intervention via a safety circuit or safety contact. If the safety circuit or the safety contact is opened, the drive is disconnected from an electrical supply. Accordingly, the drive brake is activated and the drive is switched off. The motion of the car in this case need not necessarily be braked to a standstill. Braking the motion of the car down to a speed with a value below a specified speed threshold may be sufficient. For example, if during its travel the car only reaches an impermissible excess speed instantaneously.

Preferably, the stop signal can be output to the drive by the safety system only via the first safety control unit and the trigger signal can be output to the safety brake by the safety system only via the second safety control unit.

One advantage of such an elevator is the reduction of the interfaces between the safety system and the safety-related actuators, such as the drive brake or the safety brake, which is controlled by the safety system. This simplifies the complexity of the safety system.

The first safety control unit is preferably connected to an elevator control unit and is designed to output a status signal to the elevator control unit if an impermissible safety condition is detected.

The advantage of this feature is that the elevator control unit is always aware of whether the safety system is working properly. Using this functionality means that a data line between the first safety control unit and the elevator control can also be used optimally, because no unnecessary positive status signals need to be sent to the elevator control unit. Accordingly, the data line can be dimensioned for a lower data transfer volume.

The second safety control unit is preferably connected to the first safety control unit and is designed to output a status signal to the first safety control unit if an impermissible safety condition is detected.

An advantage of this functionality is that a direct connection between the second safety control unit and the elevator control can be omitted. If the second safety control unit detects an impermissible safety condition, then a corresponding status signal from the second safety control unit to the elevator control unit is sent only indirectly via the first safety control unit. This advantage is also associated with a reduction in the number of interfaces and a reduction in the complexity of the safety system.

The second safety control unit is preferably connected to an acceleration sensor and is designed to monitor the safety condition on the basis of an acceleration signal of the acceleration sensor, wherein the second safety control unit compares the acceleration signal with a specifiable acceleration threshold value and when the acceleration threshold value is reached or exceeded, outputs a trigger signal to the safety brake.

It is advantageous here that a free fall of the car, caused for example by a rupture of the support means, is stopped quickly and reliably. This is because the processing of the acceleration signal by the second safety control unit on the car enables short signal paths for both the sensor signals from the acceleration sensor to the second safety control unit, and also for the stop signal from the second safety control unit to the safety brake. A short response time for triggering a stoppage by the safety brake is therefore guaranteed.

Preferably, the second safety control unit is connected to a position and/or speed sensor and designed to transmit a position and/or speed signal of the position and/or speed sensor to the first safety control unit. The position and/or speed sensor can be provided as a reader unit which reads code marks from a code strip, which essentially extends along the travel path of the car. The code marks represent information about the position of the car in relation to the code strip or to the travel path. The code strip serves as an information carrier. The position and/or speed sensor in this arrangement can be designed as a Hall sensor and the code strip as a magnetic strip, on which magnetic code marks are stored. Alternatively, the position and/or speed sensor or the code strip can be designed as an optical system.

In this case it is also advantageous that the raw data of the position and/or speed sensor are processed by the second safety control unit on the car itself, and therefore only data which have been processed will load the data line to the first safety control unit. The data connection between the second safety control unit and the first safety control unit is therefore only loaded with position and velocity data that are already required anyway for the elevator control.

Alternatively or optionally, the first safety control unit can also be connected to a further position and/or speed sensor and be designed to transmit a position and/or speed signal of the position and/or speed sensor to the first safety control unit. In this design, the position and/or speed sensor is arranged in a fixed position with respect to the travel path. The person skilled in the art will be familiar with different measuring systems with which it is possible to determine a position and/or speed of the car. Thus, the additional position and/or speed sensor can be based on laser or ultrasound technology. In addition, incremental measuring encoders, which monitor a rotary motion of a drive shaft of the actuator and from this generate a position and/or speed signal, are also suitable.

The first safety control unit is preferably designed to monitor the safety condition on the basis of the position and/or speed signal, wherein the first safety control unit compares the position and/or speed signal with a position and/or speed threshold value, in particular a position-dependent speed threshold, and upon reaching or exceeding the position and/or speed threshold, outputs a stop signal to the drive.

The processing of the position and/or speed-dependent safety functions by the first safety control unit and the processing of the acceleration-dependent safety functions by the second safety control unit has the advantage that the split operation keeps the computational complexity of each individual safety control unit within limits. This means that relatively inexpensive safety control units can be used.

Preferably, the position and/or velocity threshold value specifies a speed-dependent and position-dependent limit value for a movement of the car in a user-definable range around a stopping position on a landing when the car and landing doors are open, in order to prevent any unintentional movement of the car. In this arrangement the first safety control unit initiates a braking action via the drive upon reaching and/or exceeding a speed limit value and in the event of the car travelling outside of the specified range.

The position and/or speed threshold value preferably specifies a position-dependent limit value for a motion of the car in an end region of the travel path, in order to prevent a collision of the car with an end of the travel path.

The position and/or speed threshold value preferably specifies a position-dependent limit value for an excess speed of the car in the entire range of the travel path, in order to prevent an excess speed of the car.

Preferably, the limit value for the excess speed can be specified as a function of the operating mode, wherein in particular the limit value for the excess speed in a maintenance mode is chosen to be smaller than the limit value for the excess speed in a normal mode.

Preferably, the position and/or velocity threshold value specifies a speed-dependent and position-dependent limit value for an approach zone of the car to an end of the travel path, in order to ensure a controlled deceleration of the car towards the end of the travel path. If this is the case, the speed- and position-dependent limit value for the approach zone preferably decreases in the direction of the end of the travel path.

The first safety control unit is preferably connected to at least one safety contact, in particular a shaft door contact or a shaft end contact, and preferably designed to monitor the safety condition of the elevator on the basis of a switching state of the at least one safety contact, wherein the first safety control unit evaluates the switching state of the at least one safety contact and outputs a stop signal to the drive when an impermissible switching state is present.

This has the advantage that the switching states of the safety contacts, which are arranged in a fixed position with respect to the travel path, are evaluated by the first safety control unit, which is arranged physically close to them. Accordingly, due to short signal paths a switching state of a safety contact is available in a fast and reliable manner.

DESCRIPTION OF THE DRAWINGS

The invention will be explained hereafter in further detail by reference to the attached Figures. They show.

DETAILED DESCRIPTION

Figure 1:
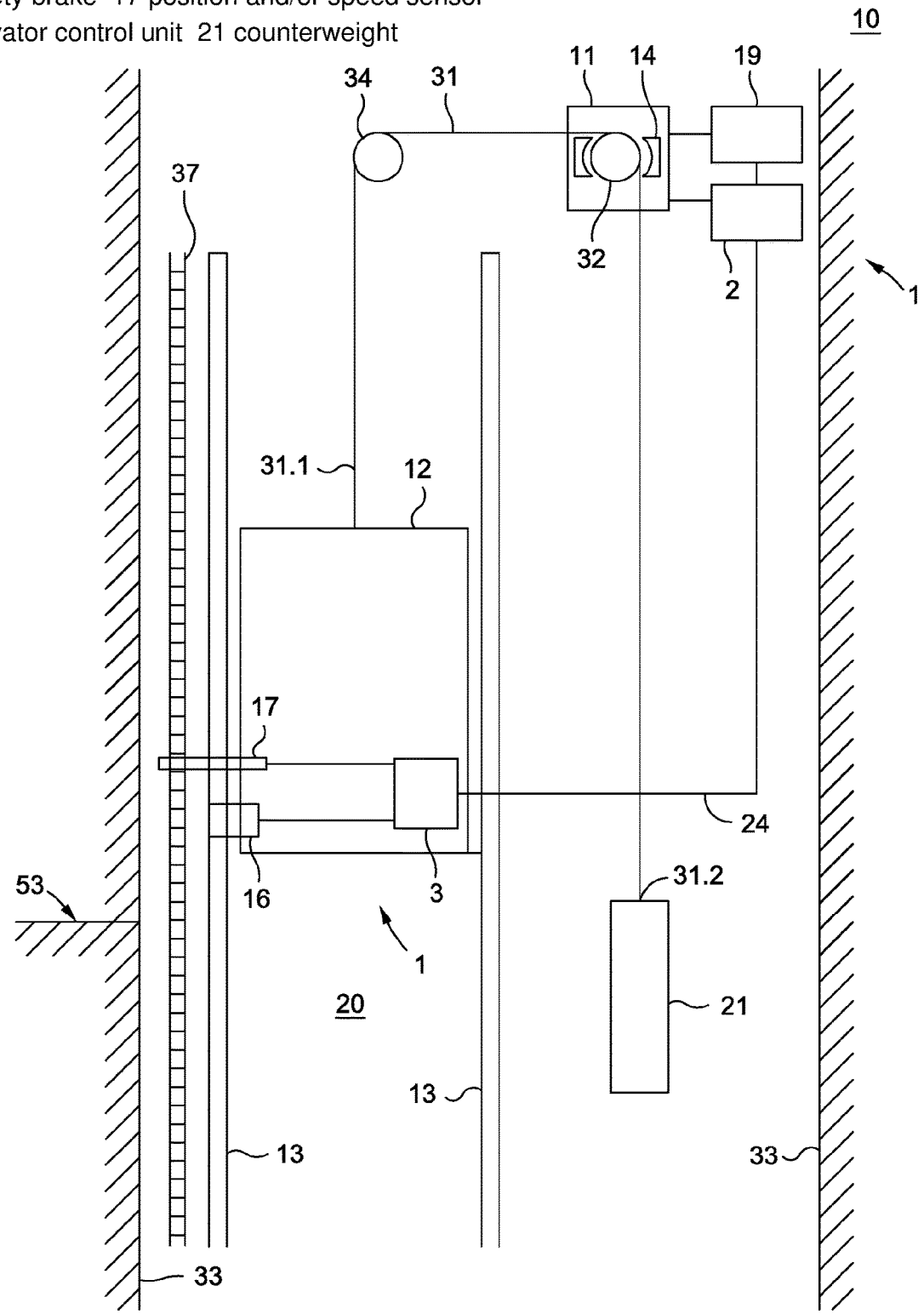
FIG. 1 an elevator with a safety system according to the invention.

FIG. 1 shows a highly systematic representation of an exemplary embodiment of an elevator 10 according to the invention. The elevator 10 comprises a car 12, which is operatively connected via a support means or support device 31, in particular a rope or strap, to a drive 11. Here, the support means 31 passes over a traction sheave 32, which is driven by the drive 11. The traction sheave 32 converts a rotational motion by means of a frictional connection to the support means 31 into a translational motion of the latter, wherein the car 12 can be displaced along a travel path 20.

Typically, the travel path 20 is bounded by four side shaft walls 33, a shaft roof and a shaft floor. The shaft roof and the shaft floor are not shown in FIG. 1. During travel the car 12 is guided along the travel path 20 on guide rails 13. To this end, the car 12 is provided with guide shoes, which engage with the guide rails 13. For reasons of clarity, the guide shoes are not shown in FIG. 1.

In addition, the car 12 is provided with a safety brake 16, which can exert a braking force on the guide rails 13 in order to brake the car 12 if required.

In the example shown, the car 12 is attached to a first end 31.1 of the support means 31 and a counterweight 21, which balances the weight of the car 12, is attached to a second end 31.2 of the support means 31. The person skilled in the art will be familiar with other suspension arrangements of the car 12 or counterweight 21, such as the suspension of the car 12 in a loop of the support means 31, the ends of the support means 31 being connected in a fixed position relative to the travel path 20, for example either directly or indirectly to shaft walls 33. The invention can thus be implemented independently of a specific suspension arrangement.

Depending on the selected arrangement, at least one or more deflection pulleys 34, or car or counterweight support rollers, can be provided for guiding the support means 31.

The drive 11 is also provided with a drive brake 14. The drive brake 14 is designed to apply a braking torque directly or indirectly onto the traction sheave 32. In this arrangement, by means of the drive brake 14 it is possible to brake a rotational movement of the traction sheave 32 or a translational movement of the car 12.

In normal operation, the drive 11 is controlled or regulated by means of an elevator control unit 19. The elevator control unit 19 registers car calls and destination entries for floors 53 to be visited, and creates a travel schedule for executing the car calls and destination entries. The elevator control unit 19 generates control signals based on the travel schedule, in order to move the car 12 to the corresponding floors 53. The elevator control unit 19 transmits these control signals to a frequency converter of the drive 11 or to the drive brake 14. For reasons of clarity, only one floor 53 is indicated in FIG. 1.

In order to ensure a safe operation of the elevator 10 at all times, a safety system 1 is provided. The safety system 1 comprises a first safety control unit 2, which is preferably arranged near to the drive 11 and controls the drive 11, and a second safety control unit 3, which is arranged on the car 12 and controls the safety brake 16. In addition, the first and the second safety control units 2, 3 are connected to one another via a data line 24, which is represented schematically. The safety system 1 is connected to the elevator control unit 19 via the first safety control unit 2.

In addition, a position and/or speed sensor 17 is connected to the car 12 in a fixed position. In the example shown, the position and/or speed sensor 17 is designed to read out a position value from a code strip 37 which is arranged along the travel path 20, and if required, to calculate a speed value therefrom. The code strip 37 bears code marks in the form of optically, magnetically or capacitively readable patterns, which are read by a suitably selected position and/or speed sensor 17. The position and/or speed sensor 17 transmits a position and/or speed signal corresponding to a position and/or speed value to the second safety control unit 3.

Figure 2:
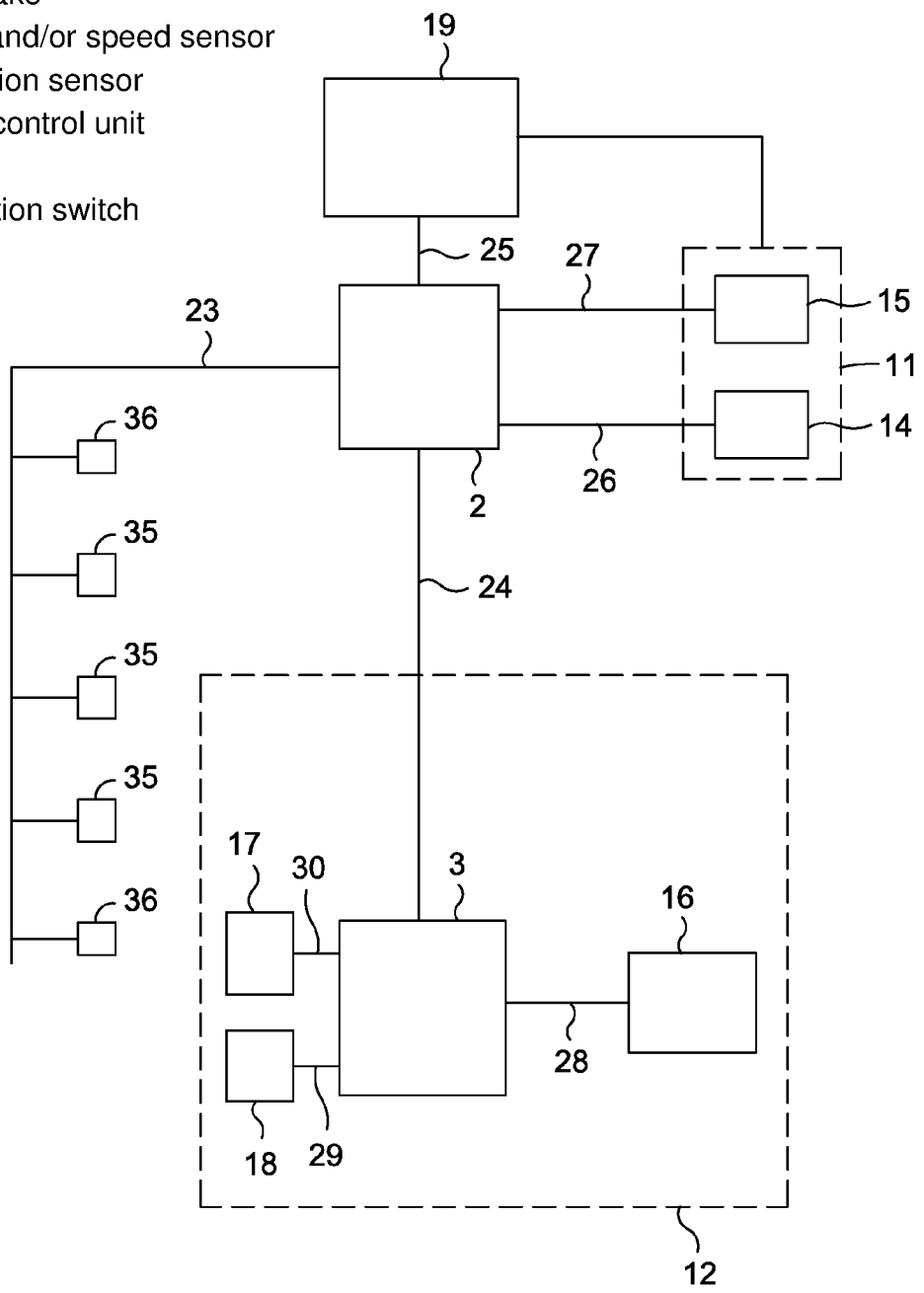
FIG. 2 a schematic illustration of the safety system shown in FIG. 1.
Figure 3:
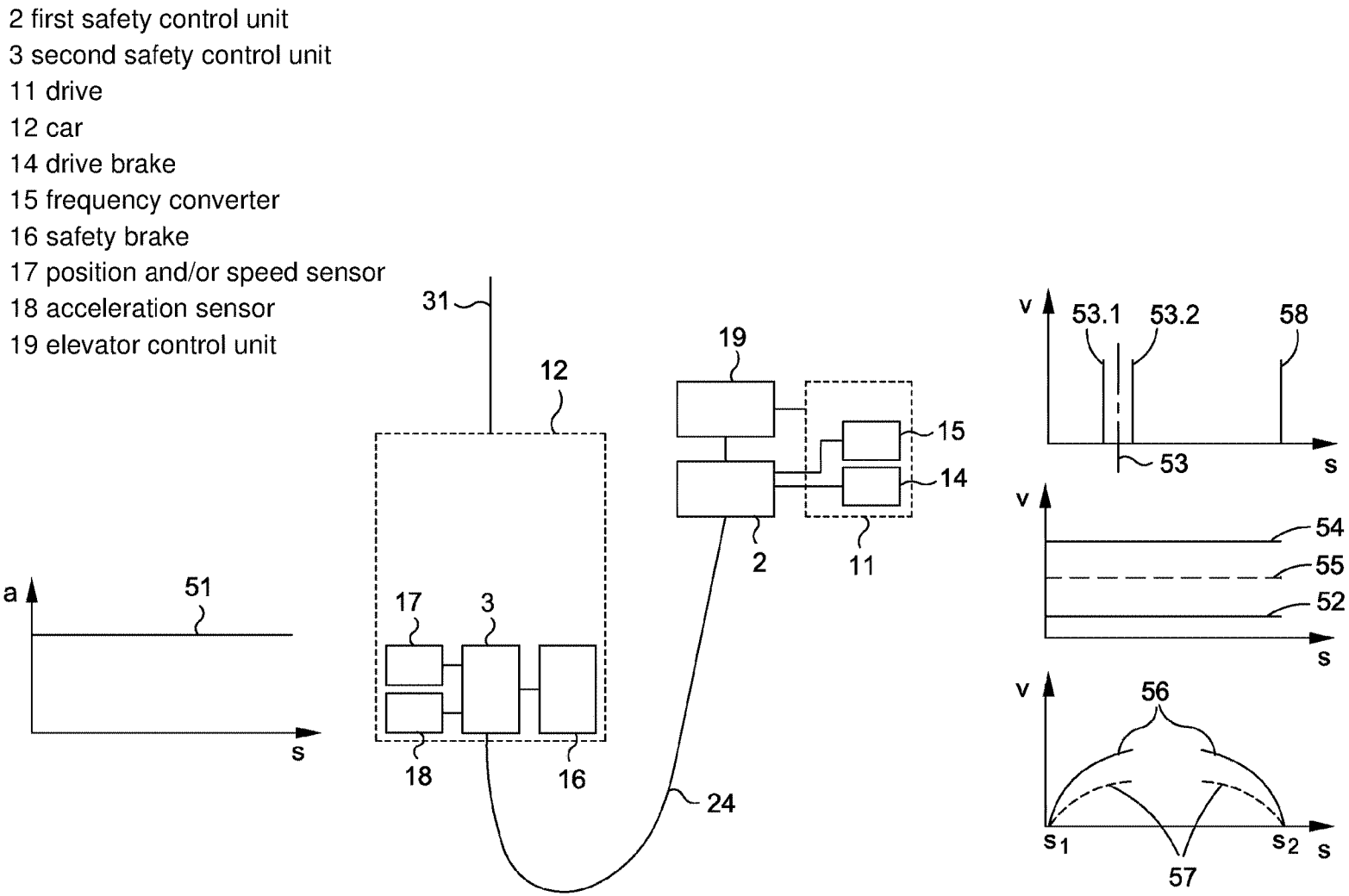
FIG. 3 a schematic representation of the safety system shown in FIG. 2 and the implemented safety functions.

FIGS. 2 and 3 show the structure and functionality of the safety system 1 in greater detail. The first safety control unit 2 and the second safety control unit 3 are connected via a data line 24, for example, a bus connection or a wireless connection.

The second safety control unit 3 is designed to evaluate at least one acceleration signal. For this purpose the second safety control unit 3 is connected via a data line 29 to an acceleration sensor 18. The acceleration sensor 18 is connected to the car 12 in a fixed position and accordingly measures the acceleration of the car 12. On the second safety control unit 3 an acceleration threshold value 51 is stored, which represents a limit value for a permissible operation of the elevator 10. Upon reaching or exceeding this acceleration threshold value 51, the second safety control unit 3 outputs a trigger signal via the data line 28 to the safety brake device 16. This ensures that in the event of an impermissibly high acceleration level, such as occurs, for example, during a free fall following a rupture of the support means 31, the car 12 is reliably braked by the safety brake 16 until it comes to a standstill.

The short signal paths between the acceleration sensor 18, the second safety control unit 3 and the safety brake 16 guarantees a rapid activation of the safety brake 16 by the second safety control unit 3.

The second safety control unit 3 is also connected to a position and speed sensor 17 via a data line 30. The position and/or speed sensor 17 is connected to the car 12 in a fixed position. The position and/or speed sensor 17 used here is implemented as an absolute positioning sensor in accordance with either of the patents EP 1 412 274 A1 or EP 2 540 651 A1. Alternatively, the position and/or speed sensor 17 can also be designed as an incremental encoder, which rolls along the guide rail 13 as a friction wheel. The position and/or speed sensor 17 transmits a position and/or speed signal to the second safety control unit 3.

The position and/or speed signals can be further processed in the second safety control unit 3. For example, a position signal can be evaluated to give a position value, or using its derivative over time to give a velocity value. The position and velocity values determined by the second safety control unit 3 are transmitted to the elevator control unit 19. In the example shown, this is effected via the data line 24, the first safety control unit 2 and the data line 25.

If a direct link exists between the elevator control unit 19 and the data line 24, then alternatively the position and velocity values can also be transmitted directly to the elevator control unit 19 by the second safety control unit 3.

The elevator control 19 processes the position and speed values when generating control signals to the drive 11, in order to accurately move the car 12 by means of the drive 11 to a predefined floor.

In addition, the position and speed values are transmitted by the second safety control unit 3 via the data line 24 to the first safety control unit 2 as well. A plurality of the following position-dependent and/or velocity-dependent safety functions can be implemented on the first safety control unit 2:

- prevention of accidental movement of the car when the car doors and shaft doors are open on a landing,
- prevention of excess speed,
- prevention of an impermissibly high speed in an end region of the travel path 20, or
- prevention of crossing of an end position at the end of the travel path 20.

To prevent an accidental motion of the car when the car doors and shaft doors are open on a landing 53, a speed threshold value 52 is stored on the first safety control unit 2. In addition, a predetermined permissible travel range about a landing 53 is defined by an upper and a lower position threshold value 53.1, 53.2, which is also stored on the first safety control unit 2. FIG. 3 shows an upper and a lower position threshold value 53.1, 53.2 for only one landing 53. Preferably, corresponding position threshold values are provided for each additional landing.

While the car 12 is stopped on the landing 53 with the car doors open, the first safety control unit 2 compares a speed value with the speed threshold value 52. If the speed value reaches or exceeds the speed threshold value 52, then the first safety control unit 2 outputs a trigger signal to stop the drive 11. In doing so the drive 11 can control the drive brake 14 via the data line 26 and/or the frequency converter 15 via the data line 27, to brake the car 12. Alternatively, the first safety control unit 2 can shut off the drive 11 by disconnecting the drive 11 from its power source, for example, by opening a switch contact.

In addition, the first safety control unit 2 also compares a position value with the upper and lower position threshold values 53.1, 53.2. Once the car 12 departs from the permissible travel range, or crosses the upper or lower position threshold value 53.1, 53.2, the first safety control unit 2 outputs a trigger signal to stop the drive 11, analogously to the above procedure.

For preventing excess speed a further speed threshold value 54 is stored on the safety control unit 2. The safety control unit 2 compares a speed value with the additional speed threshold value 54. If the speed value reaches or exceeds the other speed threshold value 54, then the safety control unit 2 issues a trigger signal to the drive 11 in order to bring the car 12 back to a permissible travel condition with a speed value which is below the other speed threshold 54. The first safety control unit 2 preferably proceeds exactly as described above.

The other speed threshold value 54 can be specified differently depending on the operating mode. For example, the other speed threshold value 54 in a normal operating mode is greater than the other threshold speed 55 in a maintenance operating mode.

For preventing an impermissibly high speed in an end region of the travel path 20, a position-dependent speed threshold value 56 is stored on the first safety control unit 2. In this case, the position-dependent speed threshold 56 decreases towards the end of the travel path. In a first embodiment, for a last permissible position s1, s2 at the end of the travel path the speed threshold value 56 can assume the value zero. Alternatively, the speed threshold value for a last permissible position at the end of the travel path can assume a maximum permissible speed value for striking a buffer.

The position-dependent speed threshold value 56 can be specified differently depending on the operating mode. For example, the position-dependent speed threshold value 56 in a normal operating mode is greater than the position-dependent threshold speed value 57 in a maintenance operating mode.

The first safety control unit 2 compares a speed and position value with the position-dependent speed threshold value 56. Upon reaching or exceeding the position-dependent speed threshold value 56, the first safety control unit 2 issues a trigger signal to the drive 11, in order to keep the car 12 below the position-dependent speed threshold value. The first safety control unit 2 preferably proceeds exactly as described above.

For preventing the crossing of an end position at the end of the travel path, a further position threshold value 58 is stored on the first safety control unit 2. The safety control unit 2 compares a position value with the other position threshold value 58 and upon reaching the other position threshold 58, issues a trigger signal to the drive 11, in order to brake the car 12 before the end of the travel path. The first safety control unit 2 preferably proceeds exactly as described above.

Alternatively, the monitoring of the end position at the end of the travel path can be effected by means of a limit position switch 36. This end contact switch 36 is connected to the first safety control unit 2 via a data line 23. The limit position switch 36 adopts an operational state as long as the car 12 has not passed over the limit position switch 36. If the car 12 passes over the limit position switch 36, the latter indicates an impermissible safety condition by virtue of adopting a safe condition. The first safety control unit 2 monitors the condition of the limit position switch 36. If the limit position switch 36 adopts a safe condition, the first safety control unit 2 issues a trigger signal to the drive 11, in order to brake the car 12 before the end of the travel path.

Further switches 35 may be connected to the first safety control unit 2 via the data line 23. These switches can be configured, for example, as shaft door contacts. These shaft door contacts 35 indicate a permissible safety condition by adopting an operating state when a shaft door is closed. In the case of an open shaft door, a shaft door contact 35 indicates an impermissible safety condition by adopting a safe condition, except if the car 12 is located on the landing with the open shaft door. The first safety control unit 2 monitors the condition of the other shaft door contacts 35 and issues a trigger signal to the drive 11 if an additional shaft door contact 35 adopts its safe condition. The first safety control unit 2 preferably proceeds exactly as described above.

If the first or the second safety control unit 2, 3 detects an impermissible safety state, then the first or the second safety control unit 2, 3, transmits a status signal to the elevator control unit 19. In the example shown, this status signal is transmitted over the data line 25 to the elevator control unit 19. In the example shown, the second safety control unit 3 can indirectly transmit the status signal to the elevator control unit 19, only via the first safety control unit 2. Alternatively, the elevator control unit 19 can be directly connected using the data line 24. Accordingly, the second safety control unit 3 can in this case transmit a status signal directly to the elevator control unit 19.

Preferably, the two safety control units 2, 3 monitor each other and exchange mutually corresponding status signals via the data line 24.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator having a drive, a car operatively connected to the drive to be moved along a travel path, at least one guide rail arranged along the travel path and guiding the car, a safety brake arranged on the car for exerting a braking force on one of the at least one guide rails, and a safety system, the safety system comprising:

a first safety control unit monitoring a safety condition of the elevator; and a second safety control unit monitoring the safety condition of the elevator, wherein the first safety control unit outputs a stop signal directly to the drive when a first impermissible safety condition of the elevator is detected and the second safety control unit outputs a trigger signal directly to the safety brake when a second impermissible safety condition of the elevator is detected, the elevator responding to the stop signal and the trigger signal to bring the elevator into a permissible safety condition, wherein the stop signal is output to the drive only by the first safety control unit, the trigger signal is output to the safety brake only by the second safety control unit, the stop signal is output to the drive by the safety system only via the first safety control unit, and the trigger signal is output to the safety brake by the safety system only via the second safety control unit.

2. The elevator according to claim 1 wherein the first safety control unit outputs the stop signal to at least one of a drive brake and a frequency converter of the drive.

3. The elevator according to claim 1 wherein the first safety control unit is connected to an elevator control unit and outputs a status signal to the elevator control unit when the first impermissible safety condition is detected.

4. The elevator according to claim 1 wherein the second safety control unit is connected to the first safety control unit and outputs a status signal to the first safety control unit when the second impermissible safety condition is detected by the second safety control unit.

5. The elevator according to claim 1 wherein the second safety control unit is connected to an acceleration sensor to monitor the safety condition based on an acceleration signal generated by the acceleration sensor, wherein the second safety control unit compares the acceleration signal with a specifiable acceleration threshold value and upon the acceleration signal reaching or exceeding the acceleration threshold value, the second safety control unit outputs the trigger signal to the safety brake.

6. The elevator according to claim 1 wherein the second safety control unit is connected to a position and/or speed sensor for transmitting a position and/or speed signal generated by the position and/or speed sensor to the first safety control unit.

7. The elevator according to claim 6 wherein the first safety control unit monitors the safety condition based upon the position and/or speed signal, wherein the first safety control unit compares the position and/or speed signal with a position and/or speed threshold value, and upon the position and/or speed signal reaching or exceeding the position and/or speed threshold value the first safety control unit outputs the stop signal to the drive.

8. The elevator according to claim 7 wherein the position and/or speed threshold value is a position-dependent speed threshold value.

9. The elevator according to claim 7 wherein the position and/or speed threshold value specifies a speed-dependent and position-dependent limit value for a motion of the car in a user-definable range around a stopping position at a floor when doors of the car and landing doors at the floor are open to prevent an accidental movement of the car.

10. The elevator according to claim 7 wherein the position and/or speed threshold value specifies a position-dependent limit value for a motion of the car in an end region of the travel path to prevent a collision of the car with an end of the travel path.

11. The elevator according to claim 7 wherein the position and/or speed threshold value specifies a speed-dependent limit value for an excess speed of the car in an entire range of the travel path to prevent an excess speed of the car.

12. The elevator according to claim 11 wherein the speed-dependent limit value for the excess speed is specified as a function of an operating mode of the elevator, wherein the limit value for the excess speed in a maintenance operating mode of the elevator is smaller than the limit value for the excess speed in a normal operating mode of the elevator.

13. The elevator according to claim 7 wherein the position and/or speed threshold value specifies a speed-dependent and position-dependent limit value for an approach zone of the car to an end of the travel path to ensure a controlled deceleration of the car towards the end of the travel path.

14. The elevator according to claim 13 wherein the speed-dependent and position-dependent limit value for the approach zone decreases towards the end of the travel path.

* * * * *